US005600991A

United States Patent [19]

Munzen

[11] Patent Number: 5,600,991

[45] Date of Patent: Feb. 11, 1997

[54] STRETCH CONTROLLED FORMING MECHANISM AND METHOD FOR FORMING MULTIPLE GAUGE WELDED BLANKS

[75] Inventor: Werner Munzen, Howell, Mich.

[73] Assignee: Ogihara America Corporation, Mich.

[21] Appl. No.: 387,418

[22] Filed: Feb. 10, 1995

[51] Int. Cl.[6] ..... B21D 22/22

[52] U.S. Cl. ..... 72/348; 72/350

[58] Field of Search ..... 72/347, 348, 350, 72/351, 379.2; 228/155, 157

[56] References Cited

U.S. PATENT DOCUMENTS

| | | | |
|---|---|---|---|
| 798,530 | 8/1905 | Rehfuss et al. | 72/351 |
| 1,898,883 | 2/1933 | Matheson | 72/347 |
| 2,112,653 | 3/1938 | MacLennan | 72/348 |
| 2,689,539 | 9/1954 | Lyon | 72/348 |
| 3,748,889 | 7/1973 | Miller . | |

FOREIGN PATENT DOCUMENTS

| | | | |
|---|---|---|---|
| 0186016 | 7/1986 | European Pat. Off. . | |
| 702089 | 4/1931 | France . | |
| 2450624 | 5/1975 | Germany . | |
| 4104256 | 8/1992 | Germany . | |
| 64422 | 4/1982 | Japan | 72/350 |
| 80928 | 4/1988 | Japan | 72/350 |
| 1438207 | 6/1976 | United Kingdom . | |

*Primary Examiner*—Lowell A. Larson

*Attorney, Agent, or Firm*—Cushman Darby & Cushman Intellectual Property Group of Pillsbury Madison & Sutro, LLP

[57] ABSTRACT

The present invention relates to a stretch controlled forming mechanism and method for preventing uncontrolled stretching, wrinkling, or splitting of welded blanks. Specifically, a stretch controlled forming mechanism is provided that, in accordance with the present invention, locks the welded blank between opposed die surfaces along the seams where the different gauge materials of the blank are welded together. Such locking prevents continued flow of material in the welded areas during the remainder of the formation process. Thus, with the jointed areas restricted from further material flow, the portion of the welded blank not previously formed can be formed between opposed dies, without damage to the welded seams or the lower gauge material of the welded blank.

20 Claims, 9 Drawing Sheets

STRETCH CONTROLLED FORMING MECHANISM AND METHOD FOR FORMING MULTIPLE GAUGE WELDED BLANKS

BACKGROUND OF THE INVENTION

1. Field of the Invention

The present invention relates to a method and apparatus for forming sheet metal and, more particularly to a method and apparatus that controls stretching of multiple gauge welded blanks during forming.

2. Description of the Related Art

Recent advancements in technology have provided blanks for stamping that are comprised of sheet metals of various gauges having different mechanical and chemical properties welded together to form a single welded blank. Conventional techniques used to weld the sheet metal components together include laser, induction, and mash welding. These welded blanks are of interest particularly to the automotive industry. Welded blanks can be formed into automotive body panels such that heavier gauge steel is positioned where strength is required, and lighter gauge steel is positioned where strength is less critical. Consequently, body panels formed from welded blanks provide weight reduction because heavier gauge material is provided only to those areas requiring additional strength. Additionally, welded blanks afford a reduction in the number of sheet metal components and welding operations required.

Conventional stamping dies, however, are generally incapable of producing satisfactory products, including automotive body panels, from welded blanks. Indeed, to produce products of satisfactory quality, it is essential to deform sheet metal blanks in a uniform manner. When conventional dies are used to form welded blanks, the lighter gauge portion of the welded blank stretches before the heavier gauge portion is subject to deformation. At a minimum, such a condition causes uneven stretch of the lighter gauge material. In the worst case, conventional dies split or wrinkle the lighter gauge material of the welded blank during forming.

SUMMARY OF THE INVENTION

It is an objective of the present invention to provide an apparatus and method for forming welded blanks that uniformly deforms the welded blank. It is a further objective of the present invention to provide an apparatus and method for forming welded blanks that prevents splitting or wrinkling of the welded blank. It is yet a further objective of the present invention to provide an apparatus and method for forming welded blanks that provides unlimited and effective control over material flow during product formation from welded blanks. It is a further objective of the present invention to provide an apparatus and method for forming welded blanks that may be adapted to a variety of configurations.

To achieve the foregoing and other objectives of the invention, a stretch controlled forming mechanism is provided that, in accordance with the present invention, forms and locks the welded blank between opposed die surfaces at the junction where the different gauge materials of the blank are welded together. Such locking prevents continued flow of material in the welded areas during the remainder of the formation process. Thereafter, with the joined areas restricted from further material flow, the portion of the welded blank not previously formed is formed between the remaining opposed surfaces of the dies.

Thus, in accordance with the present invention, a first set of opposed dies having opposed die surfaces is provided. One or all of those dies are movable relative to the others in a conventional manner. Disposed adjacent to or bounded by one of the dies of the set is a floater assembly, also having an opposed die surface. In a first embodiment of the invention, as described below, the floater assembly is disposed inwardly of the outer periphery of a lower die of the set. As one skilled in this art will appreciate after reading this description, placement of the floater is dictated by the location of the welded areas in the blank to be formed. The floater assembly is mounted to a positioning assembly so as to be movable relative to the dies of the first set. In a first embodiment of the present invention, the positioning assembly is actuated or powered by a die cushion incorporated as a part of the press.

More particularly, in the first embodiment in accordance with the principles of the invention, a first die having a die surface is provided and spaced from a second die having a die surface opposed to the first die surface. Disposed inside of the second die and slidable relative to the second die is a floater assembly that also has die surface(s) opposed to the first die surface. Again, the dies surface(s) of the floater assembly are positioned so that they will correspond to the welded areas of the blank. Thus, the floater assembly is opposed to a portion of the first die, and the second die is opposed to the remainder of the die surface of the first die.

Prior to commencement of the forming process, the floater assembly is biased by the die cushion assembly, which is of known type, so that its die surface is ahead of that of the cavity of the second die. A welded blank is placed in the apparatus so that at least a portion of a welded seam of the welded blank overlies a die surface of the floater assembly. Once the blank is so positioned, upper binders disposed peripherally of the first die and opposed to the periphery of the second die are displaced towards the second die to clamp and hold the blank in position. The first die is then moved towards and into contact with the floater assembly by conventional means. During this period, the cushion assembly biases the floater assembly against the first die with sufficient force to effect formation of the blank therebetween, thereby both forming and locking the welded portion of the welded blank between the first die and the floater assembly. This biasing force, however, is insufficient to prevent the forward progress of the first die. Thus, continued movement of the first die pushes the welded blank and displaces the floater assembly relative to the second die. During this displacement, the welded portion of the welded blank remains locked between the first die and the floater assembly. By the end of the stroke of the first die, the remaining portion(s) of the welded blank are formed between the first die and the second die.

In accordance with a second embodiment of the invention the floater assembly is disposed inwardly of the outer periphery of an upper die of the press. As in the first embodiment, the floater assembly is mounted to a positioning assembly for movement relative to the upper and lower dies. In this embodiment, the positioning assembly incorporates a pneumatic or hydraulic system to bias the floater assembly to position the die surface of the floater assembly ahead of the cavity of the upper die. When the upper die and floater assembly are displaced towards the lower die, the welded portion of the blank is formed and locked between the floater assembly and the lower die. Continued engagement of the floater assembly against the lower die displaces the floater assembly relative to the upper die and permits formation of the remaining portion(s) of the welded blank between the upper die and the lower die.

Other objects, features, and characteristics of the present invention as well as the methods of use of related elements will become more apparent upon consideration of the following description and the appended claims with reference to the accompanying drawings, wherein like reference numbers designate corresponding elements in the various figures.

DETAILED DESCRIPTION OF THE PRESENTLY PREFERRED EXEMPLARY EMBODIMENTS

Figure 1:
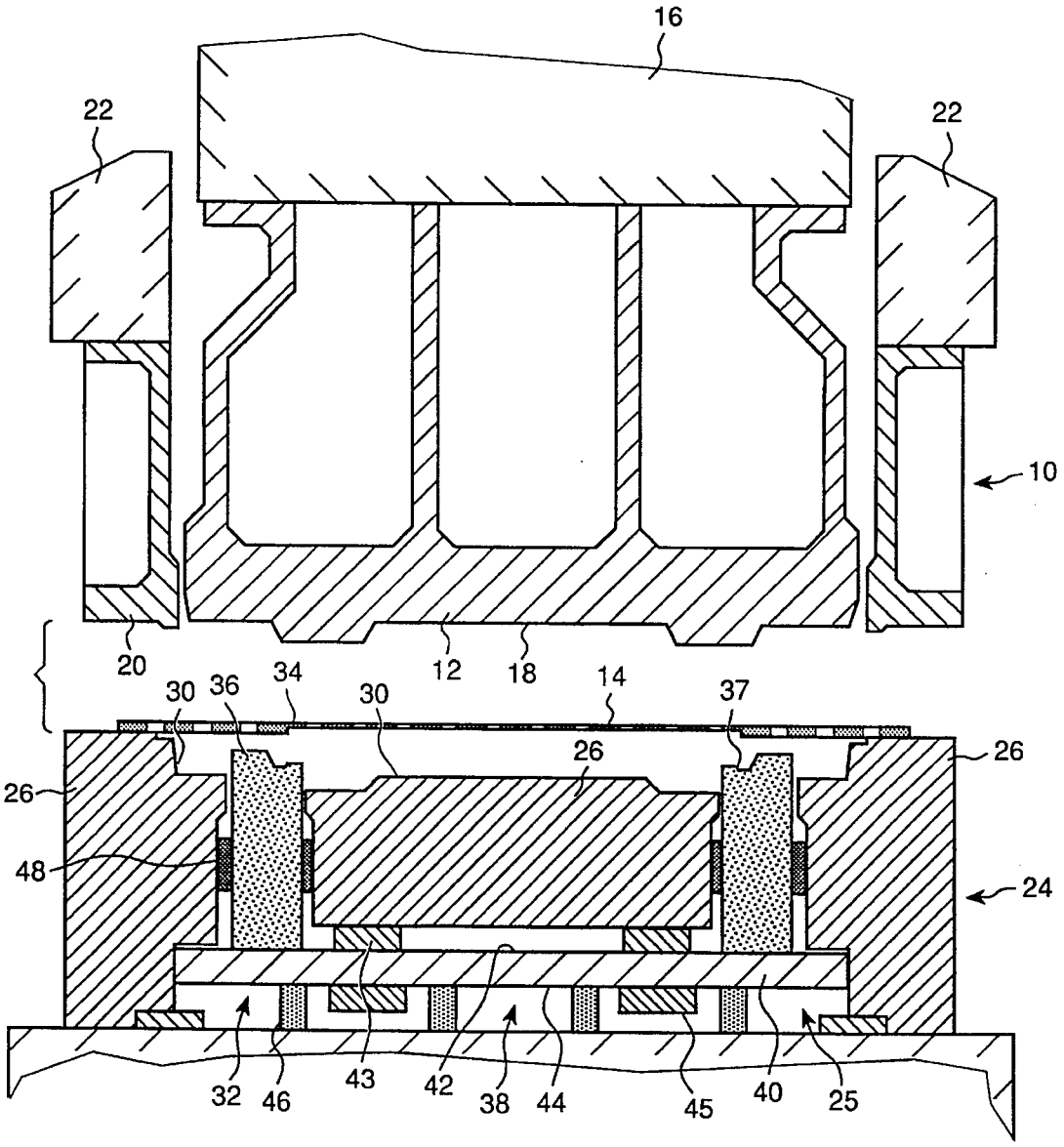
FIG. 1 is a schematic sectional view of a stretch controlled forming apparatus provided in accordance with a first embodiment of the present invention.

In FIG. 1, a first embodiment of a stretch-controlled forming mechanism in accordance with the invention, and with which the method of the invention can be carried out, is designated generally by the reference number 10. At a minimum, the mechanism of this and other embodiments of the present invention includes three blank forming die components, one of which is opposed to the other two, which are disposed adjacent one another. As one skilled in the art will recognize after reviewing the following detailed description, any number of die components greater than three may be used. Additionally, for the sake of convenience only, the dies will be referred to by the designations first, second, etc. and one of the die components, which could be characterized as a third die, will be referred to as a floater assembly because of the manner in which it is preferably, although not necessarily, mounted. Further, for convenience, the upper die will be referred to as the first die. The apparatus and method of the present invention, however, are not limited to the particular die orientations or labels used herein, as will become apparent from the detailed description provided herein below. Thus, for example, the first die could be either the upper die or the lower die and the floater assembly could be disposed adjacent to or inside of either the upper die or the lower die. As will become clear following review of this detailed description, placement of the floater assembly is dictated by the relative location of the welded areas of the blank to be formed.

As shown in FIG. 1, the molding apparatus embodying the principles of the present invention includes a first die which in the first illustrated embodiment is in the form of an upper punch 12 selectively driven towards or retracted from a workpiece comprising a welded blank 14 by a press inner ram 16 which may be of conventional construction. The first die 12 has a die surface 18 that, upon operative engagement, imparts a desired shape to the welded blank 14. An upper binder 20, which is conventionally considered as a portion of the first die 12, is mounted in surrounding relation to the first die 12 and is selectively driven towards or retracted from the workpiece 14 by a press outer ram 22, again of conventional construction, to hold the workpiece 14 during forming. Presses of this configuration commonly are called double action presses. As one of ordinary skill in this art will recognize, particularly following review of the description of the second embodiment, the present invention is not limited in application to double action presses.

Figure 7:
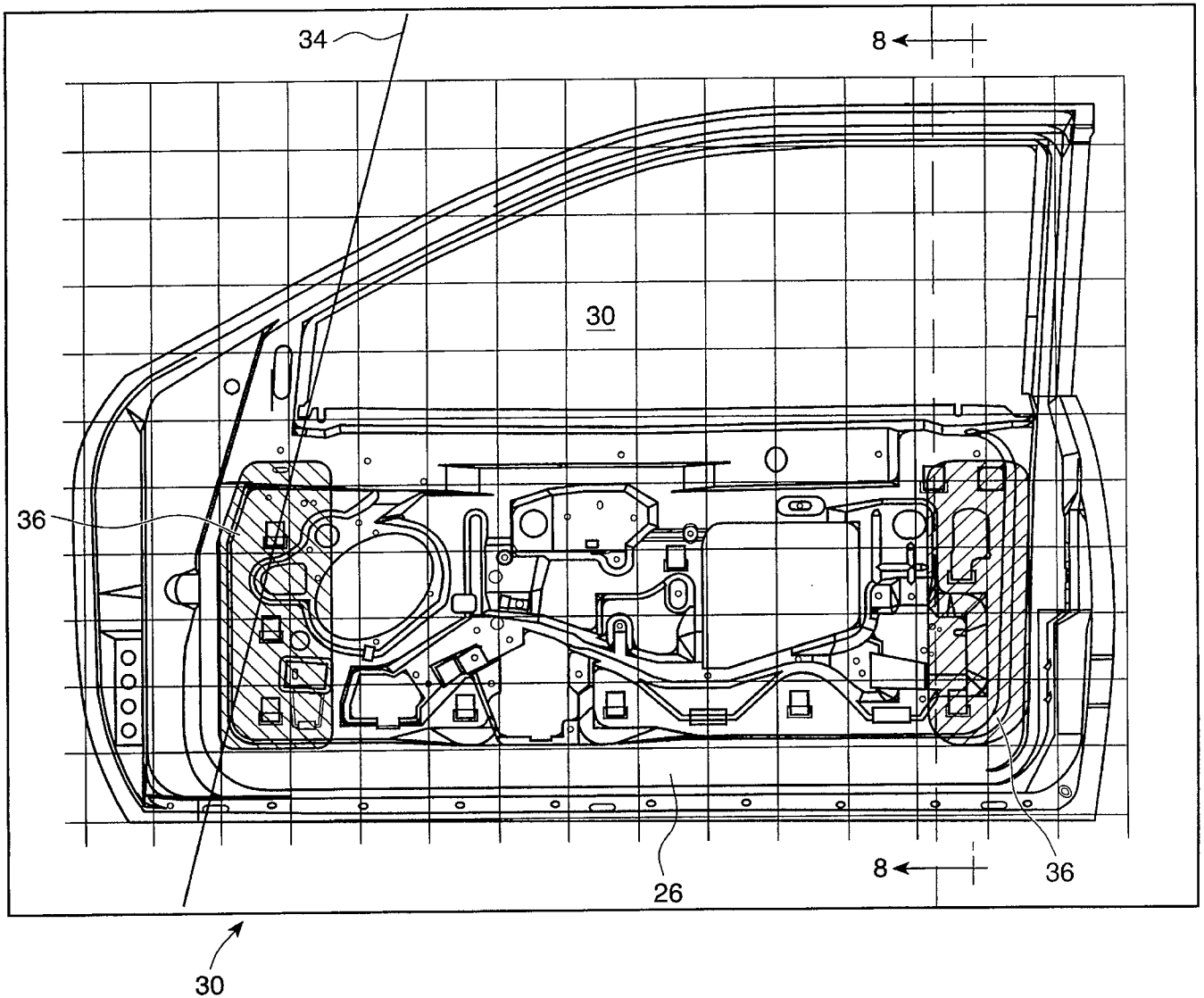
FIG. 7 is a plan view of the lower die assembly in accordance with the invention.
Figure 8:
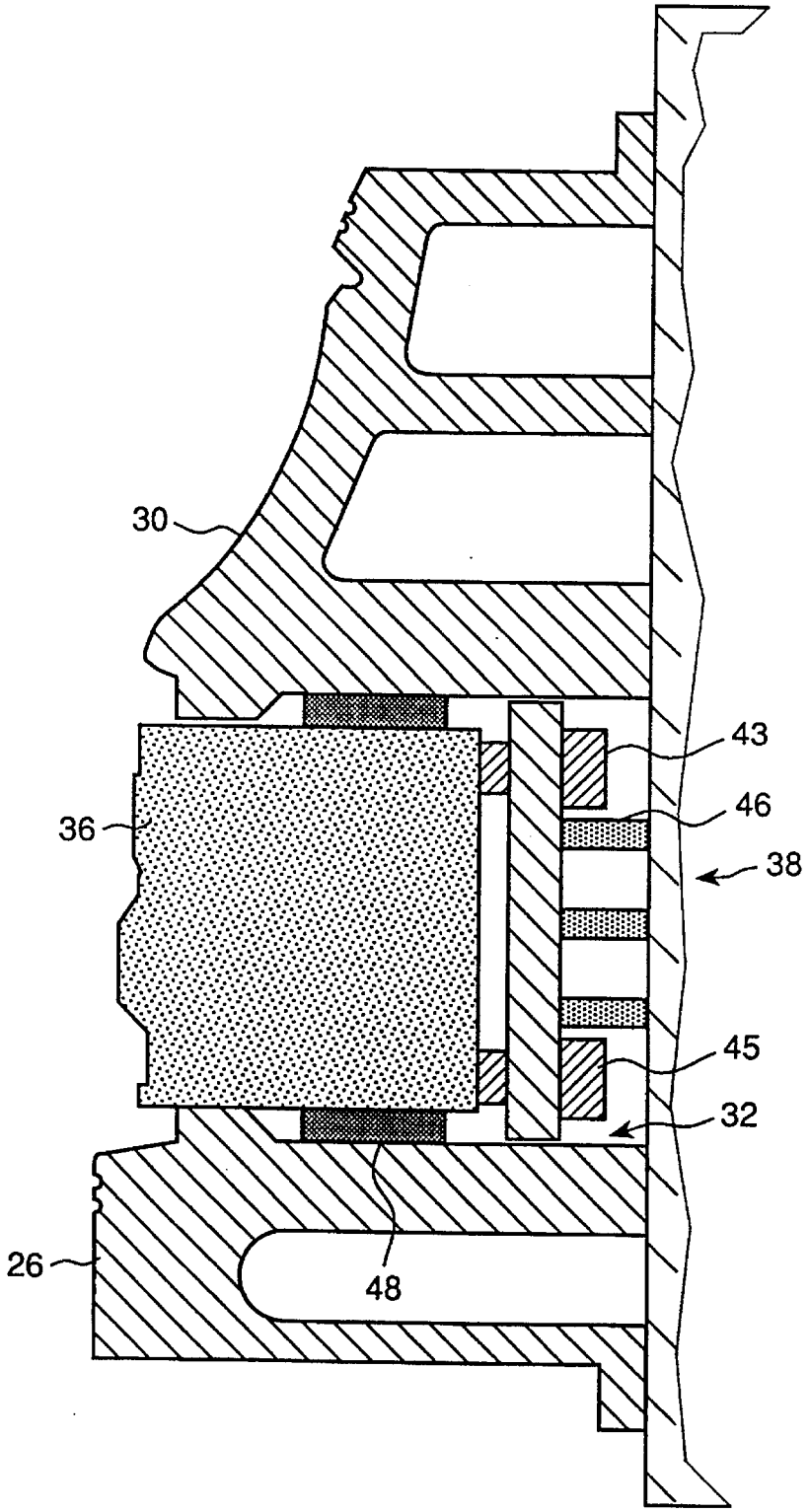
FIG. 8 is a schematic sectional view taken along line 8—8 of FIG. 7.

The molding assembly 10 further comprises a lower die assembly 24 which in the first illustrated embodiment includes the second die 26. As best seen by reference to FIGS. 1, 7, and 8, the second die 26 defines roughly a U-shaped space 25 in which other assemblies, as described below, are disposed. The second die 26 is provided in opposed, facing relation to the first die 12, and upper binder 20. The second die 26 has a die surface 30 that in conjunction with the first die surface 18 imparts a particular shape and configuration to a portion of the welded blank 14.

As shown in FIG. 1, the first embodiment of the present invention includes a displaced toward and away from the second die. The present invention, of course, only requires relative movement between the first and second dies. Thus, either or both of the dies may be movable.

In accordance with the invention, a floater assembly 32 is positioned to correspond to the locations of welded seams 34 of the blank to be formed. In the first exemplary embodiment illustrated in FIGS. 1–8, the floater assembly 32 is defined inside of the second die 26 so as to correspond to the location(s) of welded seams 34 in the welded blank 14. The floater assembly 32 may be in the form of a single die component 36 mounted inside of the second die. Alternatively, the floater assembly 32 may be comprised of a plurality of die components 36 suitably disposed about the periphery or inside of the second die as deemed appropriate or necessary to correspond to the location of the welded seams 34 of the welded blank 14 to be formed in the molding apparatus 10. While such variations will be apparent to one skilled in this art upon review of this disclosure, the first illustrated embodiment contemplates a floater assembly comprising floater die components 36 disposed inside of a second die and the description hereinbelow will be directed to that embodiment.

The floater assembly 32 comprises at least one die component 36, as noted above, hereinafter referred to in the singular as a floater component 36. In the first illustrated embodiment, the die component 36 is mounted slidably in a vertical portion of the U-shaped space 25 defined by the second die 26. It is also to be noted that in this embodiment, the blank engaging face of the floater component has a step 37 defined on the die surface thereof to lock both the light and heavy gauge sheets of the blank in a secured position during subsequent forming.

The floater assembly 32 further comprises a positioning assembly 38 for supporting the floater component 36 relative to the second die 26. In the first illustrated embodiment, the positioning assembly 38 includes a support plate 40 having a first side 42 and a second side 44. The first side 42 of the plate 40 is in supporting relation to the floater component 36. The second side 44 of the plate 40 is supported relative to the second die 26 and the press base by cushion pins 46. Stop blocks 43 are mounted to the first side 42, and bottoming blocks 45 are mounted to the second side 44. Those blocks are sized, as described more fully hereinbelow, to appropriately define the stroke of the positioning assembly 38. In the first illustrated embodiment, a single plate 40 supports the floater component 36 of the floater assembly 32. It is to be appreciated, however, that separate plates 40 may be provided for each floater component 36 of the floater assembly 32 where more than one component 36 is provided. However, to ensure simultaneous and uniform displacement of the floater component 36 of the floater assembly 32 the provision of a single continuous plate structure is currently envisioned to be most desirable. The U-shaped space 25 accommodates such a common plate.

The cushion pins 46 may be steel rods approximately 1.5 inches in diameter that extend through pin holes in the base of the press and transmit force from the die cushion assembly (not shown) to the floater plate and hence to the floater component 36. Die cushion assemblies are conventional mechanisms provided to supply power to presses so equipped. For example, cushion assemblies are used to lift, through pins, a workpiece from a die cavity following formation.

In the first illustrated embodiment, the cushion pins 46 are provided through pin holes such that sufficient support is provided for and force is applied to the floater component 36. For example, the pins may be disposed every six inches over the area of the plate 40. Generally, the floater component 36 is biased continually by the cushion assembly subject to lockout, as described more fully hereinbelow.

The force with which the floater component is biased and the displacement of the floater assembly relative to the cavity of the second die, i.e. the stroke of the floater component 36 depends on that deemed necessary or desirable to form the blank at the weld seam and to lock it during subsequent forming, the characteristics of the weld blank, the part being formed, etc. It is anticipated that optimum displacement and force values will be best determined by try-out.

As noted above, specific values for the aforementioned parameters are dictated necessarily, of course, by the design considerations presented by particular applications, and therefore, no preferred values are suggested. Orders of magnitude for those parameters observed by the inventor during experimentation, however, likely will prove typical. In one case, satisfactory results were achieved when the inner ram 16 was a 500 ton press, the outer ram 22 was an 80 ton press, the bias force of the cushion assembly was set at 19 tons, and the cushion travel was limited to 1¾ inches. In another case, satisfactory results were achieved when the inner ram 16 was a 1,200 ton press, the outer ram 22 was an 90 ton press, the bias force of the cushion assembly was set at 25 tons, and the cushion travel was limited to 60 mm.

A mechanism other than a conventional die cushion for biasing the floater component 36 may be provided in addition or in the alternative where appropriate, as will be readily evident upon review of the description of the second embodiment, including hydraulic pistons operatively engaged in hydraulic cylinders, pneumatic cylinders, and other known resilient/biasing support structures.

Wear plates 48 are suitably disposed intermediate the floater assembly 32 and each side of the vertical portion of the U-shaped space 25 of the second die 26. The wear plate(s) 48 ensure there will be smooth, low friction, axial sliding movement of the floater assembly 32 relative to the structures adjacent thereto without undue component wear.

While in the illustrated embodiment the floater assembly 32 is provided so as to be selectively displaced relative to the second die 26, it is to be understood that depending upon the shape to be imparted to the welded blank 14, and other considerations, it may be deemed advantageous or desirable to provide an assembly in which the so called floater assembly is in fact fixed and the second die is mounted for selective displacement towards the first die to impart the desired shape to the metal blank following engagement of the welded seams by the floater assembly and first die. Thus, while the first illustrated embodiment contemplates a fixed second die and a shiftable floater assembly the invention is not deemed to be limited to that particular configuration.

Figure 2:
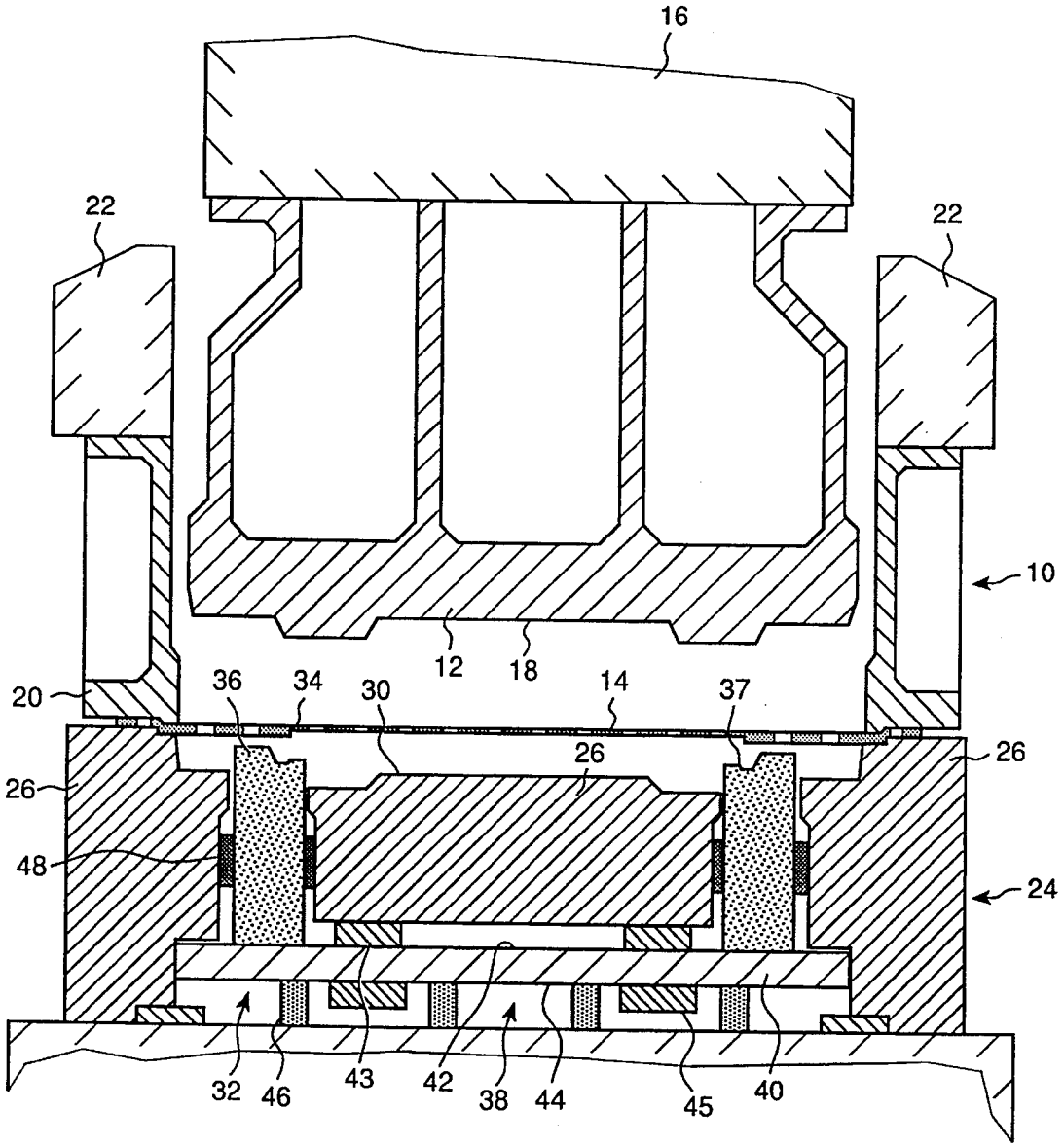
FIG. 2 is a schematic sectional view of the apparatus of FIG. 1 showing the binder clamping a blank in position between the binder and the periphery of the second die.

In use, a welded blank 14 is positioned on the top of the lower die assembly 24 while the first die 12 and upper binder 20 are disposed in their elevated positions (FIG. 1). The welded blank 14 is secured in position by the upper binder 20 once it reaches the end of its descending stroke and clamps the welded blank 14 between the upper binder 20 and the periphery of the second die 26 (FIG. 2). Once clamped and in a conventional manner, the binder 20 prevents gross movement of the workpiece yet allows blank material to flow inwardly during formation.

Figure 3:
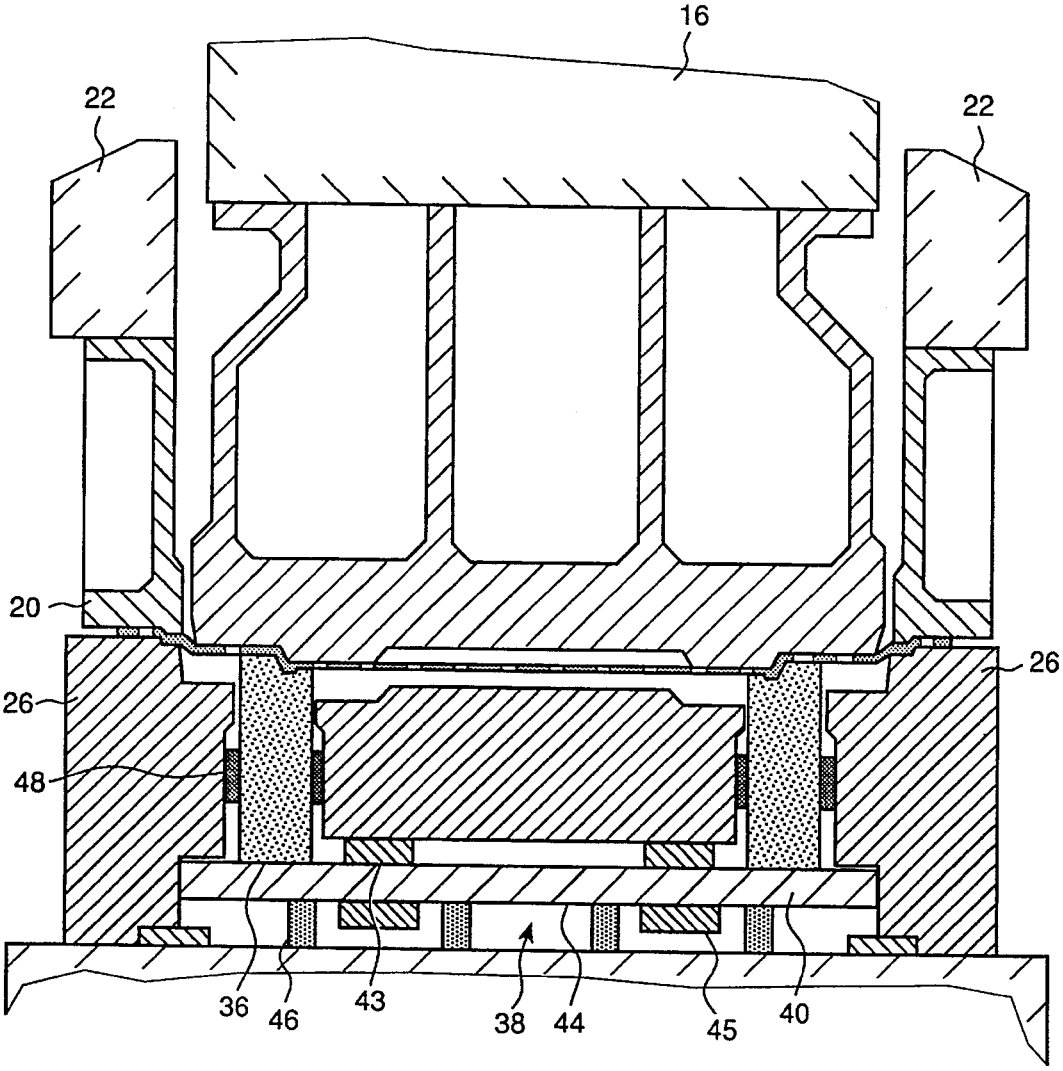
FIG. 3 is a schematic sectional view of the apparatus of FIG. 1 showing the first die displaced into engagement with the floater assembly.

The first die 12 is then displaced towards the second die 26 and the floater assembly 32. As the first die 12 contacts the welded blank 14 and displaces it relative to mated surfaces of the upper binder 20 and the second die 26, the first die 12 pushes the blank down onto the top surface of the floating component 36 of the floater assembly 32. This engagement forms or imparts a desired shape to the welded seam portions of the blank 14 and securely locks the welded seams 34 between the first die 12 and the floater component 36 (FIG. 3). As noted above, the step 37 assists in locking the welded blank in a secured position during subsequent forming.

To properly form and lock the welded portion of the welded blank, the biasing force and stroke of the cushion assembly must be selected appropriately in light of expected forming loads and final dimensions of the finished product. At a minimum, the cushion assembly must bias the floater component 36 with a force sufficient to deform the blank yet sufficiently less than that of the first die press that the floater component 36 will be displaced against its bias in response to continued movement of the first die 12. Further, the selected biasing force must be sufficient to lock the welded portion of the welded blank to isolate stretch and formation of the heavier gauge material from stretch and formation of the lighter gauge material.

Figure 4:
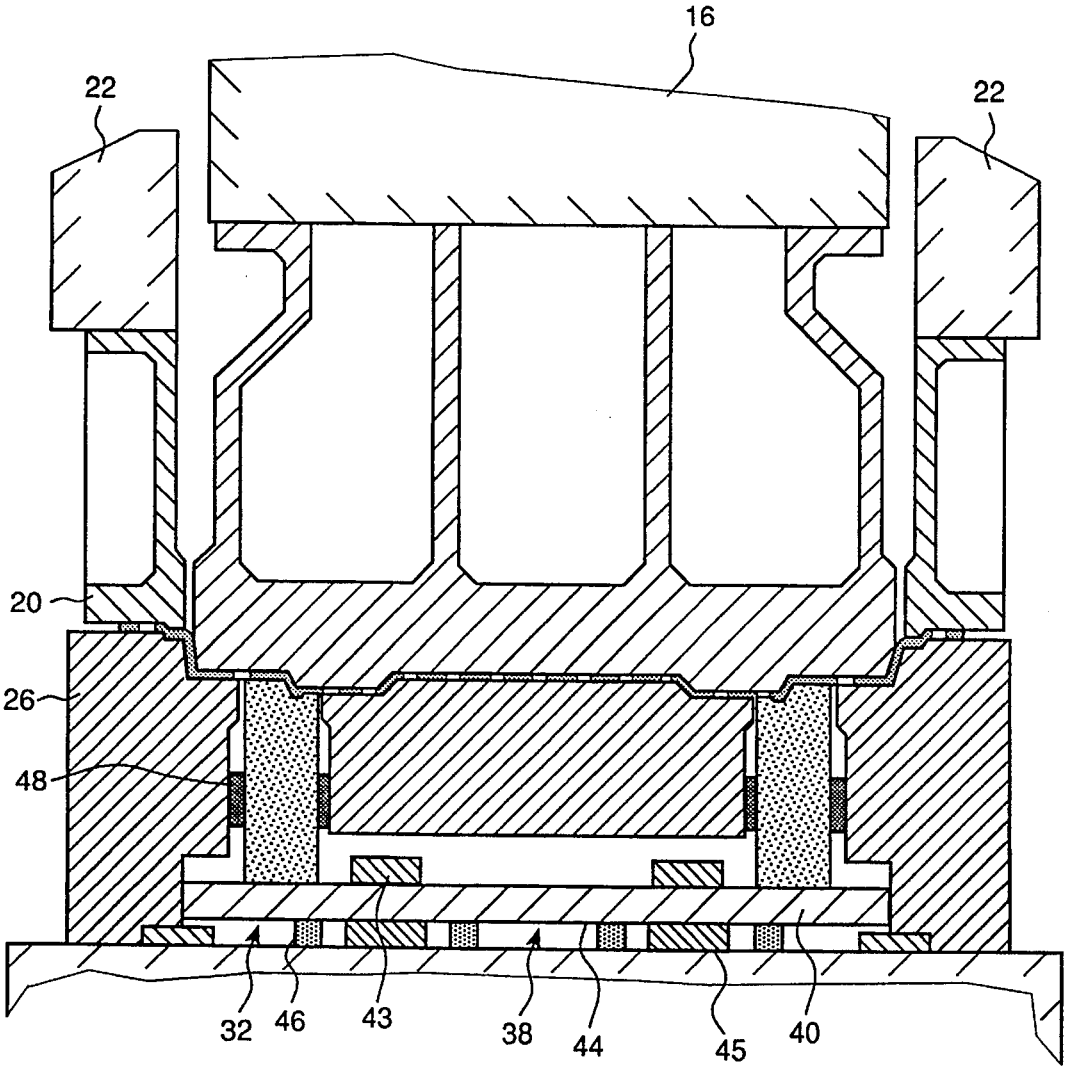
FIG. 4 is a schematic sectional view of the apparatus of FIG. 1 showing the first die displaced into engagement with the remainder of the second die.

Following forming and locking of the welded portion of the welded blank 14, continued downward motion of the first die 12 displaces the floater assembly 32 downwardly relative to the second die 26 and allows the die surface 18 of the first die 12 and the die surface 30 of the second die 26 to form the remainder of the blank (FIG. 4). Thus, at the end of the descending stroke of the first die 12, forming of the blank 14 has been substantially completed. Because the welded seam(s) 34 were clamped and locked between the first die 12 and the floater assembly 32 in advance of formation of the remainder of the blank, no cracks or splits are generated in the thinner sheet material near the joint.

As is apparent, and as was noted above, although in the illustrated embodiment the second die was fixed throughout the stroke of the first die, the second die could be mounted for movement relative to the first die if necessary or appropriate to the formation of the blank.

Figure 5:
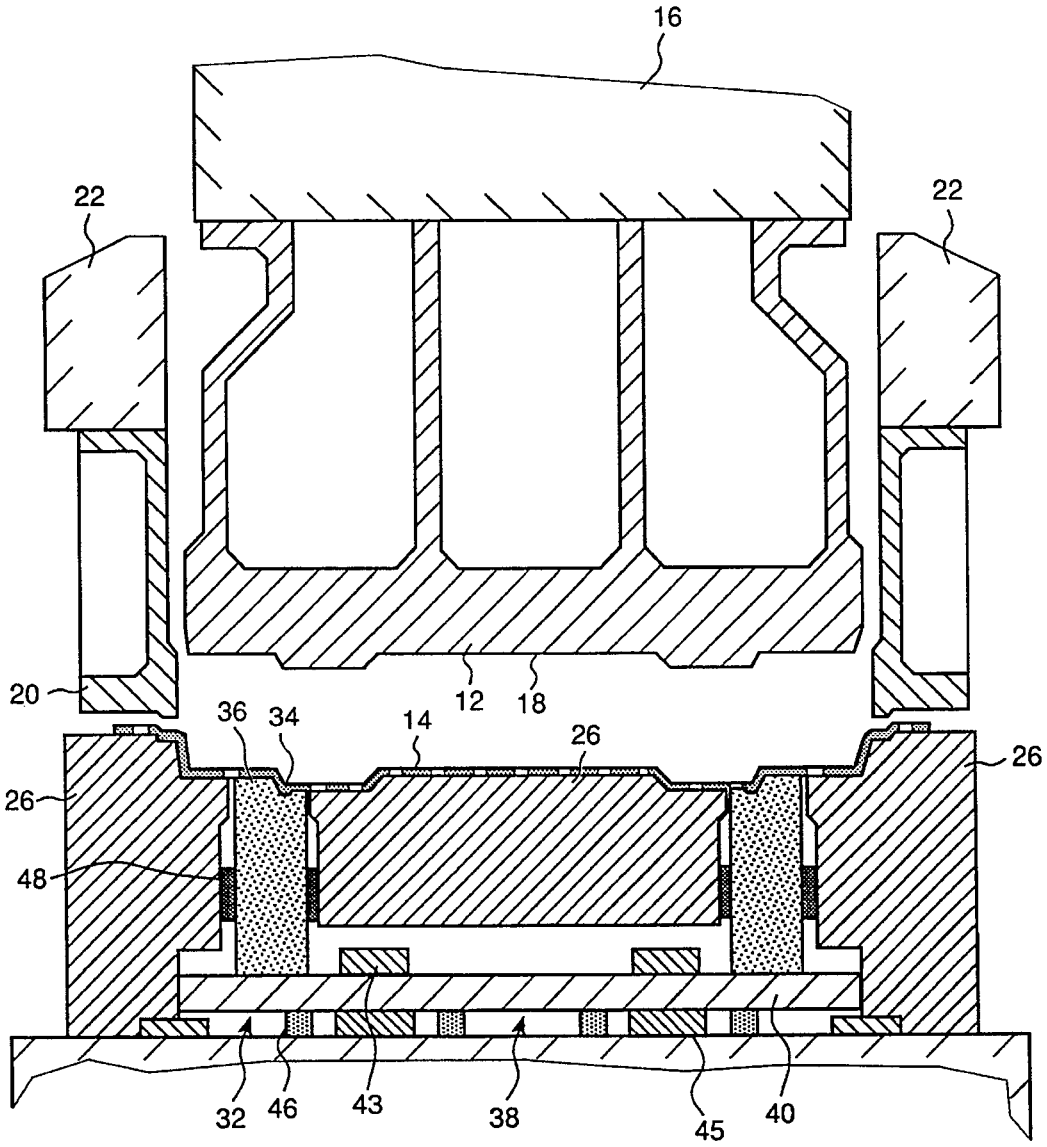
FIG. 5 is a schematic sectional view of the apparatus of FIG. 1 showing the first die retracted after formation.

Following blank formation, the first die 12 is retracted to its elevated position. Thereafter, the upper binder 20 is retracted to its elevated position. However, the floater assembly 32 remains at its bottom dead center or lower limit of its stroke until the first die 12 and the upper binder 20 are completely cleared from the molded blank 14' and are in their elevated positions (FIG. 5). The floater assembly is maintained at the lower limit of its stroke by locking out the die cushion in a known manner so that no power or biasing force is transmitted to floater assembly 32. The biasing action of the cushion assembly is reengaged following a time delay to allow sufficient time for the upper binder 20 and the first die 12 to retract, to avoid distortion of the formed blank.

Figure 6:
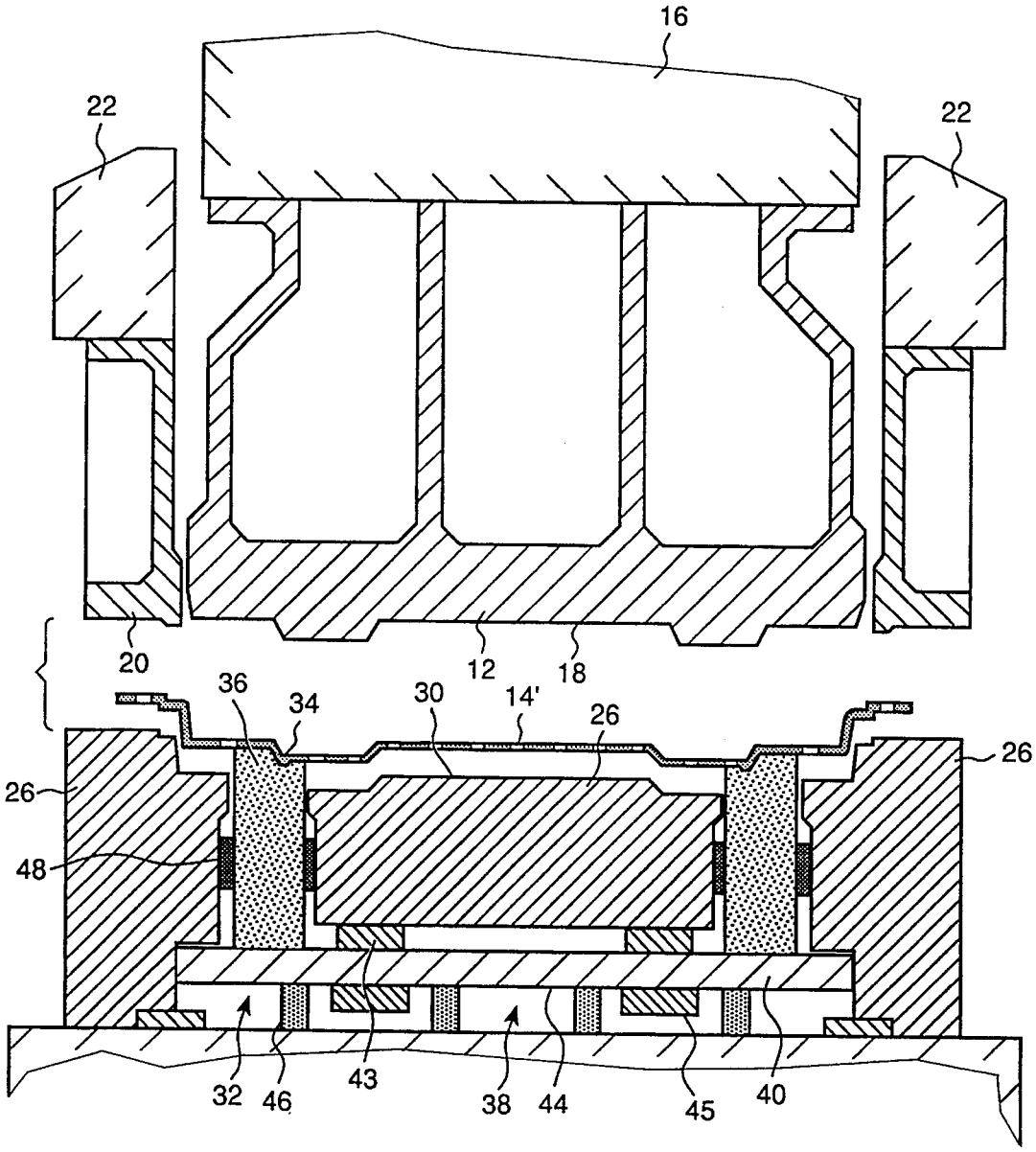
FIG. 6 is a schematic sectional view of the apparatus of FIG. 1 showing the binder dies retracted after formation and the floater assembly in its elevated position.

After the upper binder 20 is retracted to its elevated position and the time delay expires, the cushion assembly is engaged, and the floater assembly 32 is elevated to lift the formed part 14' off of the lower die 26. The formed part may then be removed and otherwise further processed (FIG. 6).

Figure 9:
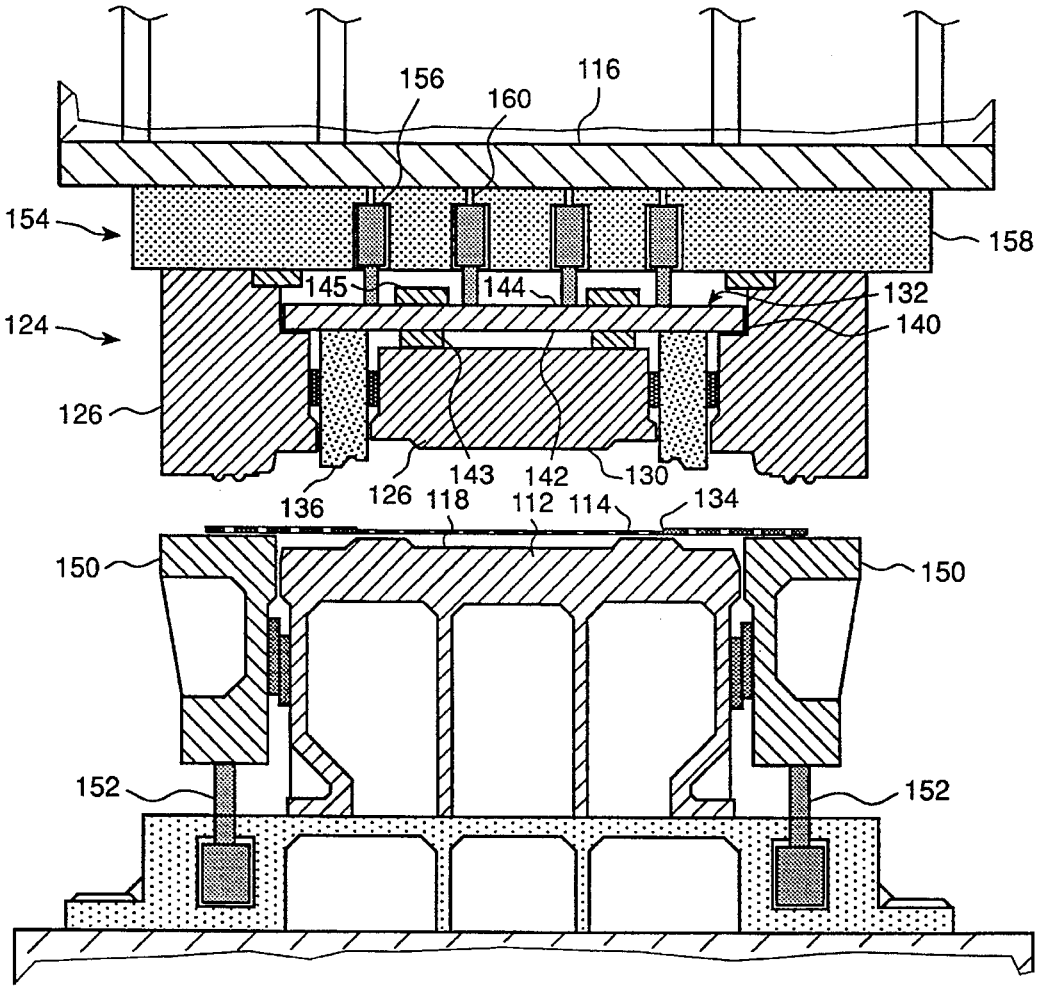
FIG. 9 is a schematic sectional view of a stretch controlled forming apparatus provided in accordance with a second embodiment of the present invention.

As noted above, some presses are not equipped with die cushion assemblies. In such apparatus or when use of the die cushion is impractical or undesirable, a hydraulic or pneumatic system may be provided to bias the floater assembly. Such an alternative system is schematically illustrated in the embodiment of FIG. 9, which is described herein below.

In the second embodiment, a floater assembly in accordance with the invention is incorporated in a single action press. As noted above, however, the present invention is not limited to a particular configuration, and the press configurations shown are intended to illustrate the flexibility of the present invention rather than suggest any limitation.

In the second illustrated embodiment, the first die 112 is provided now as a lower fixed die, and the die assembly 124 is disposed above the first die 112. Die assembly 124 is selectively driven towards or retracted from the workpiece 114 by the press ram 116. Again, the press ram 116 is of conventional design.

The first die 112 is fixed to a press bed and includes the die surface 118 that imparts a desired shape to the welded blank 114. A blank holder 150 is mounted in surrounding relation to the first die 112 and serves the same function as a binder. Specifically, biasing cylinders 152, for example nitro cylinders, disposed below the blank holder 150 push the facing surface of the holder above the die surface 118 and provide sufficient force to clamp the blank 114 during forming. In a known manner, the blank holder 150 prevents gross movement of the blank during forming while still allowing inward material flow.

The die assembly 124 comprises in part the second die 126 including the U-shaped space in which the positioning assembly of the second embodiment is disposed. The second die 126 is provided in opposed, facing relation to the first die 112 and the blank holder 150. The second die includes the die surface 130 that in conjunction with the first die surface 118 imparts a particular shape and configuration to a portion of the welded blank 114.

The floater assembly 132 is defined inside of the second die 126 and is positioned to correspond to the locations of the welded seams 134 of the blank to be formed. As was noted above with respect to the first embodiment, and remains true in this exemplary embodiment, the floater assembly 132 may include a single die component 136 or a plurality of such die components disposed about the periphery or inside of the second die as deemed necessary by the position of the welded seams 134. As with the first embodiment, the blank engaging face of the floater component 136 preferably includes a step 137 to positively lock the welded portion of the blank 114 in a secured position during subsequent forming.

The floater assembly 132 further comprises a positioning assembly 154 incorporating many of the components of the positioning assembly 38 of the first illustrated embodiment. The positioning assembly 154 of the second embodiment includes the plate 140 having a first side 142 and a second side 144. The first side 142 is in engaging relation to the floater component 136. The second side 144 is in engaging relation to a drive assembly 156, described more fully hereinbelow. Stop blocks 143 and bottoming blocks 145 are mounted to the plate 140. Those blocks are sized and serve the same function as those indicated in the description of the first illustrated embodiment. Again, it is to be appreciated that separate plates may be provided for each floater component 136.

In the second illustrated embodiment, the drive assembly 156 serves a function similar to that of the cushion assembly. The drive assembly 156 includes an adapter plate 158 disposed between the press ram 116 and the second die 126. A plurality of drive devices 160 housed within the adapter plate 158 are engaged operatively to the plate 140. Suitable drive devices 160 may be, for example, hydraulic or pneumatic cylinder and piston assemblies. For this illustrated embodiment, the drive devices are pneumatic cylinders. Notwithstanding the illustrated structure, the particular drive devices provided in accordance with the second embodiment of the invention depend upon the desired displacement of the floater component 136 during the descending stroke of the die assembly 124 and the necessary load to lock and form the welded portion of the blank 114.

The drive assembly 156 further includes supply lines, exhaust lines, and a storage tank (not shown in detail). The drive assembly 156 continually biases the floater component 136 subject to lockout. During formation, the pneumatic cylinders are pressurized to push the floater component 136 towards its extended position with sufficient force to form and lock the welded portion of the welded blank. When required, as described below, the pneumatic cylinders can be selectively deactivated by exhausting to tank.

The second illustrated embodiment is used to form the welded blank in a manner generally similar to the first embodiment. A welded blank 114 is positioned on the elevated surface of the blank holder 150 while the die assembly 124 is in its elevated position. Thereafter, the press ram 116 pushes the die assembly 124 towards the welded blank 114. Because the blank holder 150 is elevated slightly relative to the first die 112, a peripheral portion of the second die 126 clamps the blank 114 against the blank holder 150 prior to any other contact between the dies and the blank. The blank holder 150 retracts under the force of the second die 126, and the biasing force of the nitro cylinders 152 prevents gross movement of the blank 114 during subsequent forming. At this stage, the blank 114 contacts the die surface 118 of the first die 112.

Continued downward motion of the die assembly 124 displaces the blank holder 150 and brings the floater component 136 into contact with the welded portion of the welded blank 114. This engagement forms the welded portion of the blank 114 and securely locks that portion between the floater component 136 and the first die 112. The discussion of required forces and displacements in regard to the first illustrated embodiment is generally applicable here, and therefore, is not repeated.

Following forming and locking of the welded portion of the welded blank 114, continued downward motion of the die assembly 124 displaces the floater component 136 against the biasing action of the pneumatic cylinders and allows the die surface 130 of the second die 126 and the die surface 118 of the first die 112 to form the remainder of the blank. Again, because the welded seam 134 was locked between the first die 112 and the floater component 136 prior to formation of the remainder of the blank, no wrinkling or splitting occurs.

Following formation, the pneumatic cylinders are exhausted to tank thereby unloading the biasing force of the drive devices 160. Thereafter, the die assembly 124 is retracted to its elevated position and moves relative to the floater assembly 132. The floater assembly 132 moves relative to the second die 126 under its weight and gently pushes the formed workpiece 114' away from the die cavity.

It should be noted that the embodiment of FIG. 9 is seen to be particularly advantageous when forming, for example, an automotive body panel, such as a door, because the formed part does not need to be turned over in advance of further processing, as would be the case with a press of the type shown in FIG. 1.

Indeed, as is apparent from the foregoing, the floater assembly of the invention can advantageously be incorporated either in the upper or lower die structure of a press. This flexibility permits the advantages of the invention to be realized in a variety of part forming systems.

While the invention has been described in connection with the preferred embodiments, it should be understood readily that the present invention is not limited to the disclosed embodiments. Rather, the present invention is intended to cover various equivalent arrangements and methods included within the scope of the appended claims.

What is claimed is:

1. A forming mechanism providing controlled stretch of a blank formed thereon, the forming mechanism comprising:

a first die member;

a second die member disposed in opposed facing relation to the first die member, at least one of the first die and the second die being mounted for selective movement toward and away from the other of the first die and the second die; and a floater assembly comprising at least one blank engaging component disposed adjacent to said second die, the floater assembly being mounted for axial sliding movement relative to the second die;

said floater assembly further comprising a support assembly for said component, said support assembly being constructed and arranged to selectively dispose said at least one blank engaging component in a first position in which a blank engaging surface thereof is closer to said first die member than a blank engaging surface of said second die member such that said blank engaging component can lock a portion of the blank between said blank engaging component and said first die when said first die engages said blank engaging component thereby preventing further flow of material of said portion and to permit said blank engaging component and the locked portion of the blank to be displaced axially from said first position upon engagement of said component by said first die during a forming stroke thereof.

2. A forming mechanism according to claim 1, wherein the first die is movable toward and away from the second die and the second die is fixed.

3. A forming mechanism according to claim 1, wherein the support assembly comprises a plate having a first surface and a second surface, the first surface being in operative engagement with said component, and a spring assembly in operative engagement with said second surface of the plate.

4. A forming mechanism according to claim 3, wherein said spring assembly at least selectively urges said component toward said first die.

5. A forming mechanism according to claim 4, wherein said spring assembly comprises a plurality of cushion pins.

6. A forming mechanism according to claim 1, wherein at least one blank engaging component are arranged so as to substantially correspond to a location and arrangement of welded seams of a blank to be formed by said first and second dies.

7. A forming mechanism according to claim 1, wherein the floater assembly further comprises at least one wear plate disposed between said component and said second die.

8. A forming mechanism according to claim 1, further comprising an upper binder engageable to a periphery of said second die for clamping and holding a peripheral edge of a blank to be formed by said first and second dies.

9. A forming mechanism according to claim 1, wherein said at least one blank engaging component is disposed inside of said second die.

10. A forming mechanism according to claim 1, further comprising an upper binder and a lower binder for clamping and holding a peripheral edge of a blank to be formed by said first and second dies.

11. A method for forming a blank, comprising the steps of:

providing a molding apparatus comprising:

first die member;

a second die member disposed in opposed facing relation to the first die member, at least one of the first die and the second die being mounted for selective movement toward and away from the other of the first die and the second die; and a floater assembly comprising at least one blank engaging component disposed adjacent to said second die, the floater assembly being mounted for axial sliding movement relative to the second die, said floater assembly having a support assembly for said component, said support assembly being constructed and arranged to selectively dispose said at least one blank engaging component in a first position in which a blank engaging surface thereof is closer to said first die member than a blank engaging surface of said second die member and to permit said blank engaging component to be displaced axially from said first position upon engagement of said component by said first die member during a forming stroke thereof;

placing a metal blank intermediate said first and said second die members;

displacing said first die member toward said second die member;

locking a first portion of said blank between said first die member and said blank engaging component thereby preventing further flow of material of said first portion;

displacing said first die member, said blank engaging component and said first portion of said blank clamped therebetween towards said second die member; and forming a second portion of the blank spaced from said first portion between the first die member and the second die member.

12. A method as in claim 11, where the step of providing a molding apparatus comprises providing a molding apparatus having an upper binder, and further comprising the step of clamping a periphery of said blank between said upper binder and a periphery of said second die before said step of clamping a first portion.

13. A method as in claim 11, where the step of providing a molding apparatus comprises providing a molding apparatus having upper and lower binders, and further comprising the step of clamping a periphery of said blank between said upper and lower binders before said step of clamping a first portion.

14. A method as in claim 11, wherein said at least one blank engaging component is disposed inside of said second die.

15. A method as in claim 11, wherein said step of placing a metal blank comprises placing a metal blank having at least one welded seam intermediate said first and said second die members.

16. A method as in claim 11, wherein said step of placing a metal blank comprises placing a steel blank intermediate said first and second die members.

17. A method for forming a welded blank having a relatively light gauge portion, a relatively heavy gauge portion and a welded portion defined therebetween, said method controlling stretch of said welded blank formed thereby, the method comprising the steps of:

forming said welded portion of said welded blank;

locking said welded portion thereby preventing further flow of material of said welded portion; and forming remaining portions of said welded blank while the welded portion is locked.

18. A method for forming a metal blank, said method controlling stretch of said blank formed thereby, the method comprising the steps of:

providing a metal blank having a first portion to be formed and a second portion to be formed;

forming said first portion of said blank;

locking said first portion of said blank thereby preventing further flow of material of said first portion; and forming said second portion of said blank while the first portion is locked.

19. A method as in claim 18, wherein said step of providing a metal blank comprises providing a steel blank.

20. A method as in claim 18, wherein said step of providing a metal blank comprises providing a metal blank having portions of differing gauges.

* * * * *